US008091438B1

(12) United States Patent
Huang

(10) Patent No.: US 8,091,438 B1
(45) Date of Patent: Jan. 10, 2012

(54) TORSION TOOL

(75) Inventor: Kuang-Hsin Huang, Taichung (TW)

(73) Assignee: Taken Etorque Technology Co., Ltd., Taichung (TW)

( * ) Notice: Subject to any disclaimer, the term of this patent is extended or adjusted under 35 U.S.C. 154(b) by 0 days.

(21) Appl. No.: 12/906,065

(22) Filed: Oct. 15, 2010

(51) Int. Cl.
*B25B 23/14* (2006.01)

(52) U.S. Cl. ..... 73/862.23

(58) Field of Classification Search ... 73/862.21–862.23
See application file for complete search history.

(56) References Cited

U.S. PATENT DOCUMENTS 6,463,811 B1 * 10/2002 Putney ..... 73/862.21
6,796,190 B2 * 9/2004 Curry ..... 73/862.21
6,948,380 B1 * 9/2005 Shiao et al. ..... 73/862.21
6,981,436 B2 * 1/2006 Becker et al. ..... 81/479
7,469,602 B2 * 12/2008 Gharib et al. ..... 73/862.21
7,469,619 B2 * 12/2008 Anjanappa et al. ..... 81/479
7,565,844 B2 * 7/2009 Crass et al. ..... 73/862.21
7,841,245 B1 * 11/2010 Chen ..... 73/862.23

* cited by examiner

*Primary Examiner* — Lisa Caputo
*Assistant Examiner* — Octavia Davis

(57) ABSTRACT

A torsion tool includes a body having an operating head formed thereon for driving a workpiece and a power set disposed therein. A control assembly is installed into the body and includes a seat received therein. The seat includes a microcontroller disposed therein and a sensor electrically connected to the microcontroller, wherein the sensor is disposed in the body for sensing the change of the operating torsion. A transceiver and a switch are respectively electrically connected to the microcontroller. A first conducting set is disposed in the seat. A display module is detachably received in the seat for showing torsion value. The display module includes a second conducting set electrically connected to the microcontroller of the display module, wherein the second conducting set is selectively electrically connected to the first conducting set for directly receiving the signal from the microcontroller of the seat.

16 Claims, 7 Drawing Sheets

TORSION TOOL

BACKGROUND OF THE INVENTION

1. Field of the Invention

The present invention relates to torsion tool, and more particularly to a torsion tool that includes a detachable display module for easily reading the torsion data during operating and a vibrating assembly for alarming the operator when the operating torsion value reaches the pre-install torsion value.

2. Description of Related Art

In early stages, all the conventional torsion tools are mechanical such that the operator determines whether the operating torsion is reached to the preinstall torsion value or not by all-or none principle. Consequently, the operator can not understand the change of the torsion during operation. As a result, a lighting element or a voice element is disposed on the torsion wrench for alarming the operator when the operating torsion value reaches the pre-installed torsion value. However, the lighting element and the voice element can not indeed alarm the operator when the operator is distracted. In addition, the conventional torsion tool has no display module or the display module is fixed such that the operator can not easily read the operating torsion value during operating the conventional torsion tool.

The present invention has arisen to mitigate and/or obviate the disadvantages of the conventional torsion tools.

SUMMARY OF THE INVENTION

The main objective of the present invention is to provide an improved torsion tool that includes a detachable display module for easily reading the torsion data during operating and a vibrating assembly for alarming the operator when the operating torsion value reaches the pre-install torsion value.

To achieve the objective, the torsion tool in accordance with the present invention comprises a body having a operating head formed thereon for driving a workpiece and a power set disposed therein. A control assembly is installed into the body. The control assembly includes a seat received in the body. The seat includes an internal microcontroller disposed therein and a sensor electrically connected to the microcontroller, wherein the sensor is disposed in the body for sensing the change of the operating torsion and transmits the change to the change to the microcontroller. A transceiver and a switch are respectively electrically connected to the microcontroller. A first conducting set is disposed in the seat. A display module is detachably received in the seat for showing torsion value. The display module includes a microcontroller disposed therein and a second conducting set electrically connected to the microcontroller of the display module, wherein the second conducting set is selectively electrically connected to the first conducting set for directly receiving the signal from the microcontroller of the seat.

Further benefits and advantages of the present invention will become apparent after a careful reading of the detailed description with appropriate reference to the accompanying drawings.

DETAILED DESCRIPTION OF THE INVENTION

Figure 1:
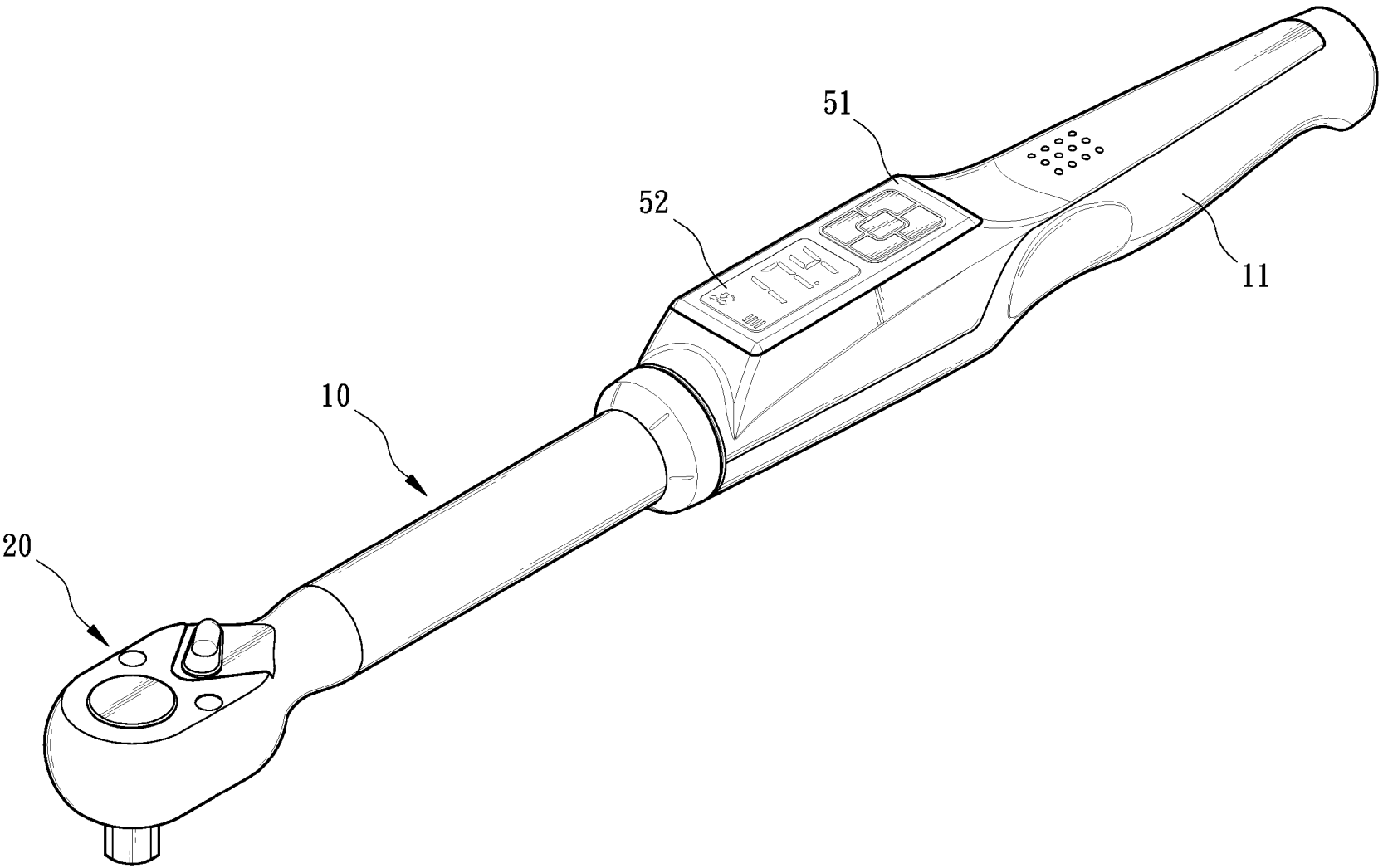
FIG. 1 is a perspective view of a first embodiment of the torsion tool in accordance with the present invention.
Figure 2:
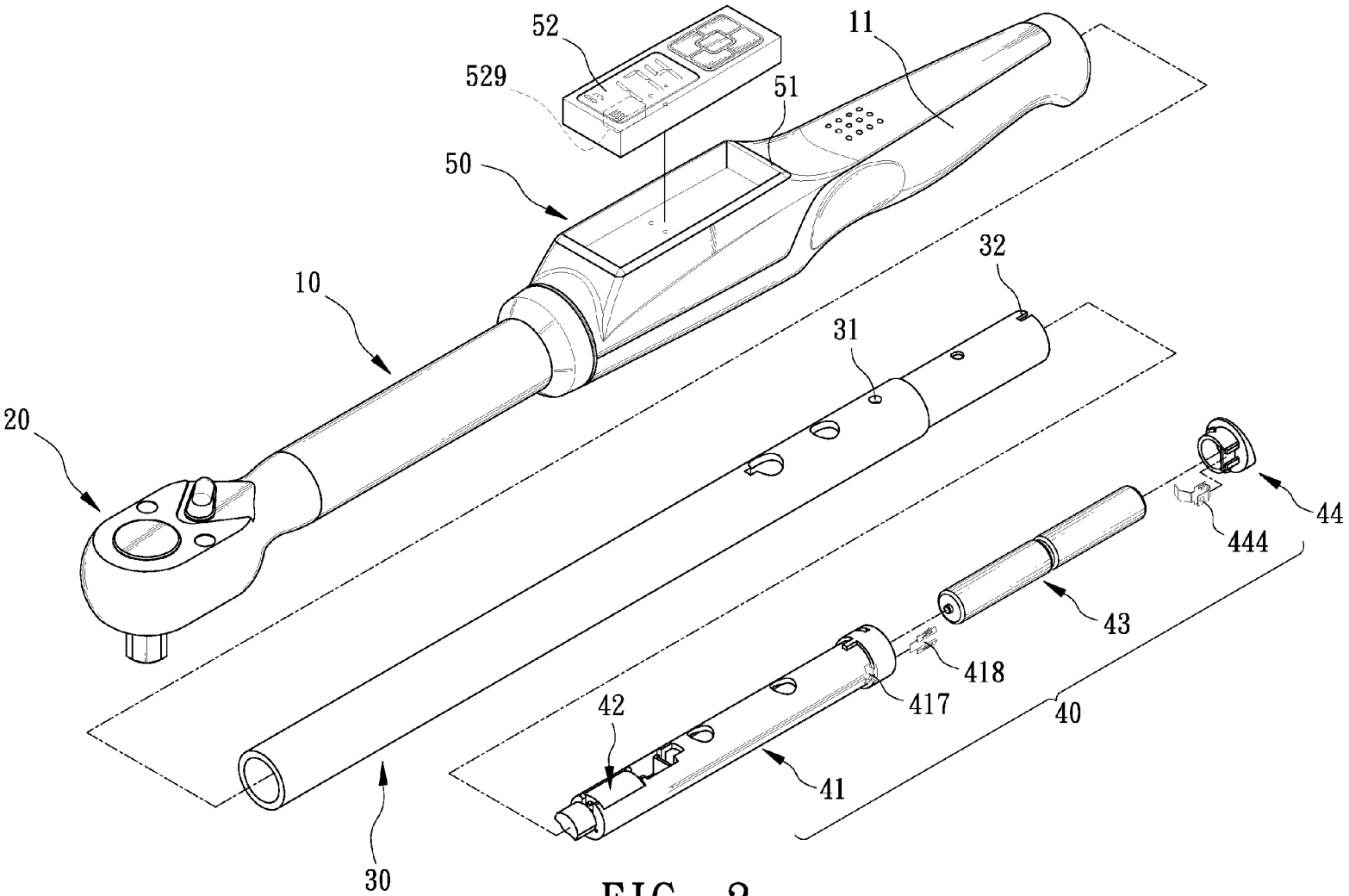
FIG. 2 is a perspective exploded view of the torsion tool in FIG. 1.
Figure 3:
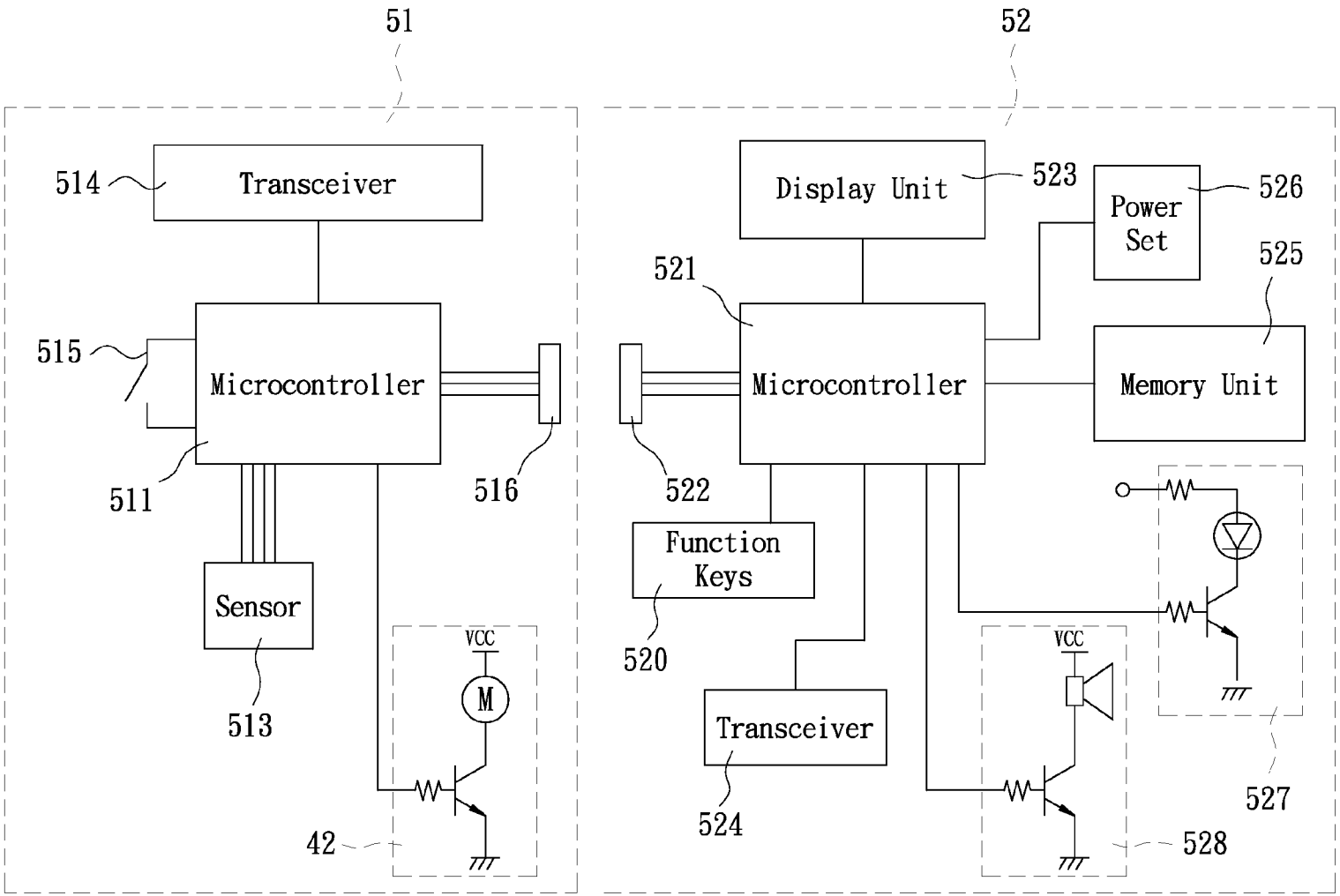
FIG. 3 is a circuit diagram of a control assembly of the torsion tool in accordance with the present invention.

Referring to the drawings and initially to FIGS. 1-3 and 7, a torsion tool in accordance with the present invention comprises a body (10/10') having an operating head (20/13) formed thereon. A control assembly (50) is installed into the body (10/10'). The control assembly (50) includes a seat (51) received in the body (10/10') and a display module (52) detachably received in the seat (51), wherein the seat (51) is electrically to the torsion tool for receiving energy from the torsion tool.

The seat (51) includes an internal microcontroller (511) disposed therein and a sensor (513) is electrically connected to the microcontroller (511), wherein the sensor (513) is disposed in the torsion wrench for sensing the change of the operating torsion and transmits the change to the change to the microcontroller (511). A transceiver (514) and a switch (515) are respectively electrically connected to the microcontroller (511). A first conducting set (516) is disposed in the seat (51).

The display module (52) includes a microcontroller (521) disposed therein and a second conducting set (522) electrically connected to the microcontroller (521) of the display module (52), wherein the second conducting set (522) is selectively electrically connected to the first conducting set (516) for directly receiving the signal from the microcontroller (511) of the seat (51). A display unit (523) and multiple function keys (520) are respectively disposed in the display module (52) and electrically connected to the microcontroller (521) of the display module (52). The display unit (523) is provided to show the data, such as the pre-install torsion value or the operating torsion value, from the microcontroller (511) of the seat (51) and the multiple function keys (520) are provided to install torsion value or change the display mode of the display unit (523). In the preferred embodiment of the present invention, the display unit (523) is an LCD displayer. A transceiver (524) is disposed in the display module (52) and electrically connected to the microcontroller (521) of the display module (52) for receiving the signal from the transceiver (514) of the seat (51) and showing on the display unit (523). A memory unit (525) is disposed in the display module (52) and electrically to the microcontroller (521) of the display module (52) for saving the operating data. A power set (526) is disposed in the display module (52) and electrically connected to the microcontroller (521) of the display module (52). The display module (52) directly uses the energy from the torsion tool via the seat (51) when the display module (52) is received in the seat (51), and the first conducting set (516) and the second conducting set (522) are electrically connected to each other. The power set (526) provides energy to the display module (52) when the display module (52) is detached from the seat (51). The display module (52) in accordance with the present invention further includes a lighting unit (527) and a voice unit (528) respectively disposed therein and electrically connected to the microcontroller (521) of the display module (52) for alarming the operator by different ways when the operating torsion value reaches the installed torsion value. In addition, a magnet (529) is mounted into a bottom of the display module (52) such that the display module (52) can be adhered to a machine tool of a workpiece for operator to easily read the torsion data from the display unit (523) after the display module (52) being detached from the seat (51).

Figure 4:
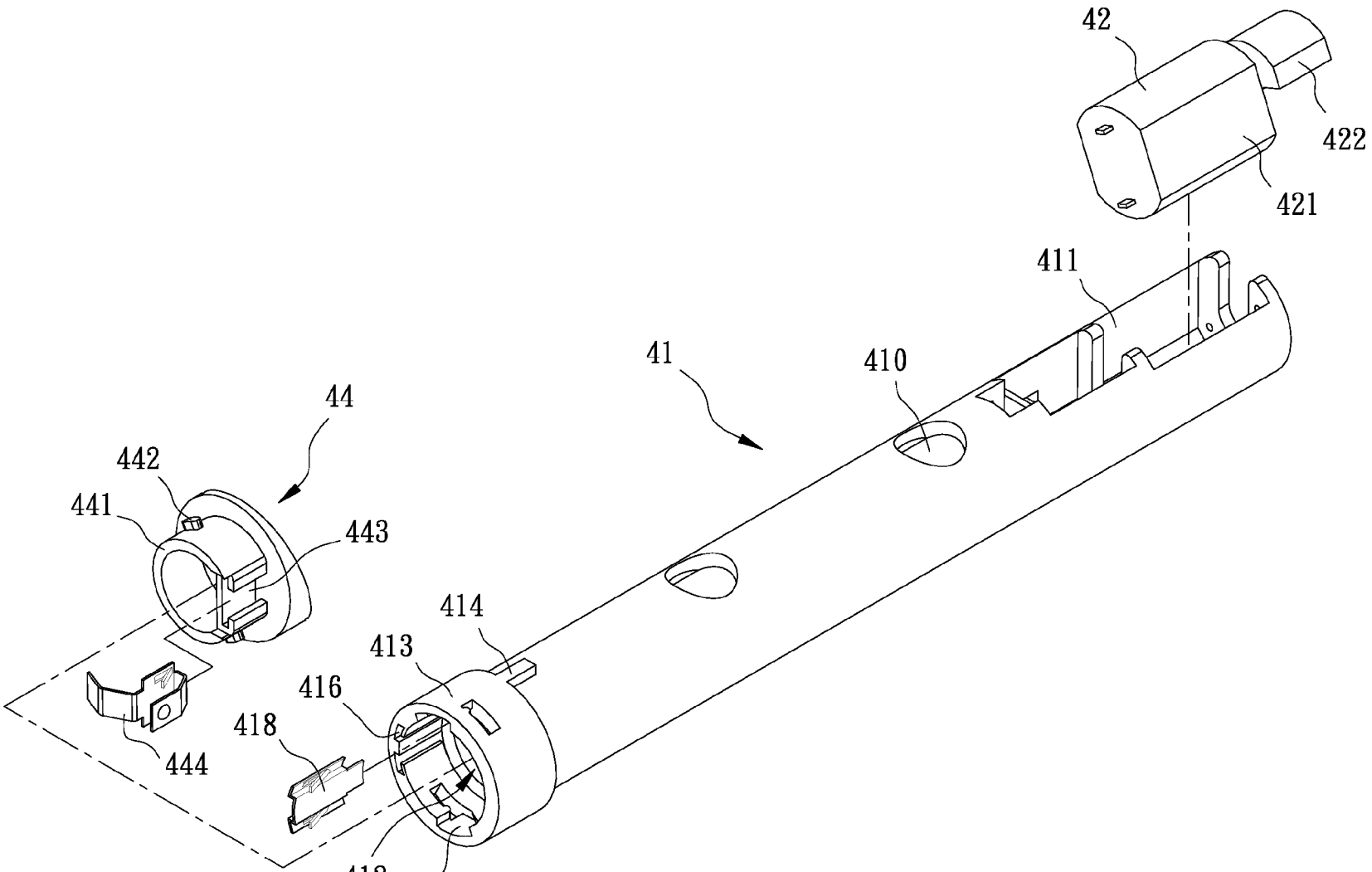
FIG. 4 is a rear perspective exploded view of a vibrating assembly of the torsion tool in FIG. 1.
Figure 5:
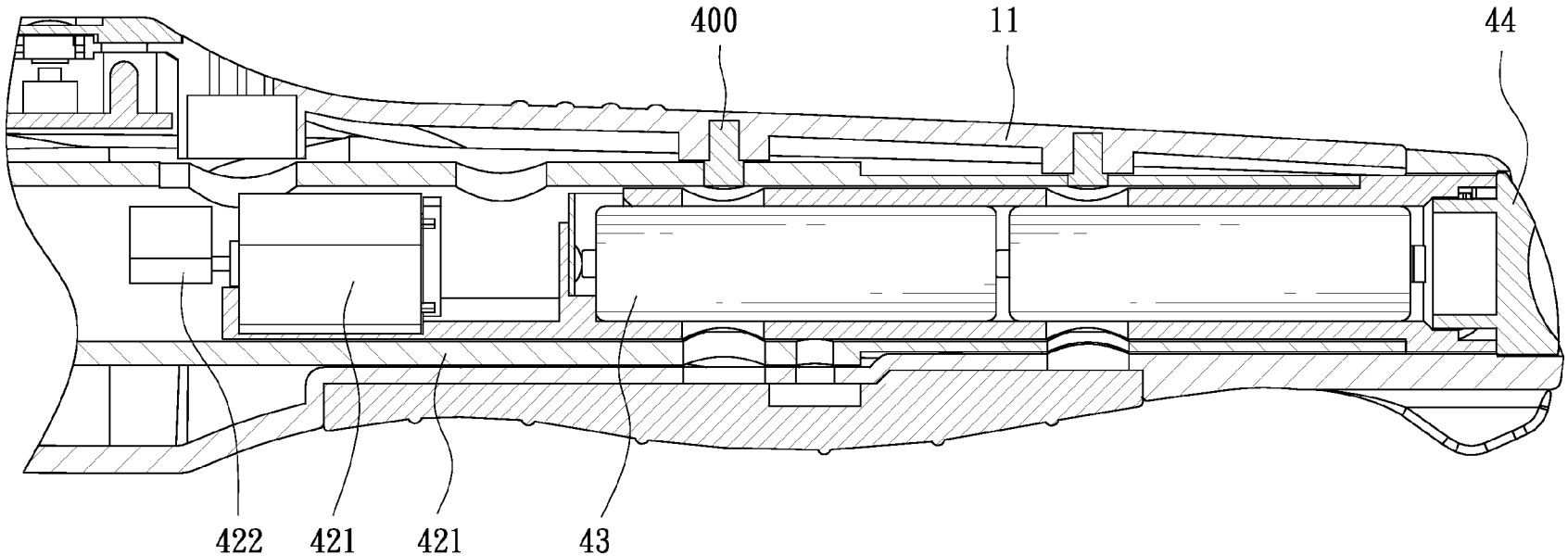
FIG. 5 is a partially cross-sectional view of the torsion tool in FIG. 1.
Figure 6:
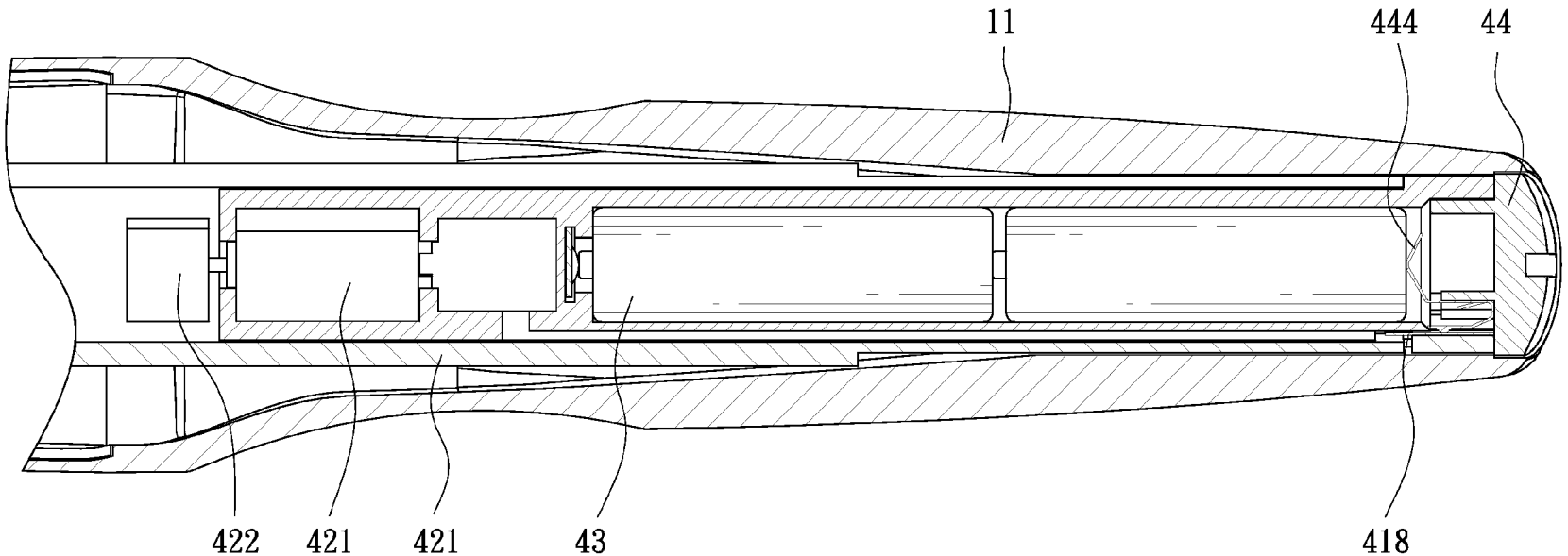
FIG. 6 is another partially cross-sectional view of the torsion tool in FIG. 1.

Further with reference to FIGS. 4 to 6, the first embodiment of the torsion tool in accordance with the present invention is a torsion wrench and the body (10) is a hollow shank, and the operating head (20) is a ratchet head and provided to connect to a socket (not shown). The torsion tool includes a ratchet head (20) disposed on a front end of the body (10) for connecting to a socket (not shown) and a metal tube (30) inserted into a rear end of the body (10). A vibrating assembly (40) is mounted in the metal tube (40). The vibrating assembly (40) is operated for alarming the operator when the operating torsion value reaches the pre-installed torsion value. The rear end of the body (10) is formed with a hand-held portion (11) and the seat (51) of the control assembly (50) is mounted into the hand-held portion (11).

The metal tube (30) has multiple through holes (31) defined therein and multiple indentations (32) defined in a rear end thereof.

The vibrating assembly (40) includes an inner tube (41) inserted into the metal tube (30) and corresponding to the hand-held portion (11). A vibrating set (42) is received in a front end of the inner tube (41). A power set (43) is received in the inner tube (41) and electrically connected to the vibrating set (42), and an end piece (44) is longitudinally and detachably mounted to a rear end of the inner tube (41) to prevent the power set (43) from detaching from the inner tube (41). The power set (43) of the vibrating assembly (40) is electrically to the microcontroller (511) of the seat (51) for providing energy.

The inner tube (41) has a trough (411) defined in a front thereof, and a tunnel (412) defined therein and extending to a rear end thereof. The inner tube (41) has a flange (413) radially extending from the rear end thereof. Multiple protrusions (414) extend from a shoulder of the flange (413), wherein each protrusion (414) engaged into a corresponding one of the multiple indentations (32) in the metal tube (30). The inner tube (41) has multiple through holes (410) defined therein, wherein each through hole (410) of the inner (41) aligns with a corresponding one of the multiple through holes (31) in the metal tube (30) for allowing multiple fixing member (400) sequentially extending through the inner tube (41) and the metal tube (30) to hold the inner tube (41) and the metal tube (30) in place in the body (10). The inner tube (41) has multiple L-shaped recesses (415) and a groove (416) defined in an inner periphery of the tunnel (412) near the rear end of the inner tube (41). An opening (417) is defined in the inner tube (41), wherein the opening (417) extends through the inner tube (41) and communicates with the groove (416). A first conducting plate (418) is inserted into the groove (416), and has a free end extending through the opening (417) and contact with the metal tube (30).

The vibrating set (42) includes a motor (421) received in the trough (411) and a counterweight (422) eccentrically mounted to a shaft (not numbered) of the motor (421) such that the vibrating set (42) provides a vibrating effect for alarming the operator when the motor (421) is operated. The power set (43) of the vibrating assembly (40) is received in the tunnel (412) and electrically connected to the seat (51).

The end piece (44) includes a skirt (441) extending therefrom and multiple stubs (442) radially extending from an outer periphery of the skirt (441). Each stub (442) is selectively engaged into a corresponding one of the multiple recesses (415) for holding the end piece (44) in place on the rear end of the inner tube (41). A T-shaped groove (443) is longitudinally defined in the outer periphery of the skirt (441) and a second conducting plate (444) is stably inserted into the T-shaped groove (443). The second conducting plate (444) has two opposite ends respectively electrically contacting with the power set (43) of the vibrating assembly (40) and the first conducting plate (418) for transmitting energy to the vibrating set (42) via the metal tube (30).

Figure 7:
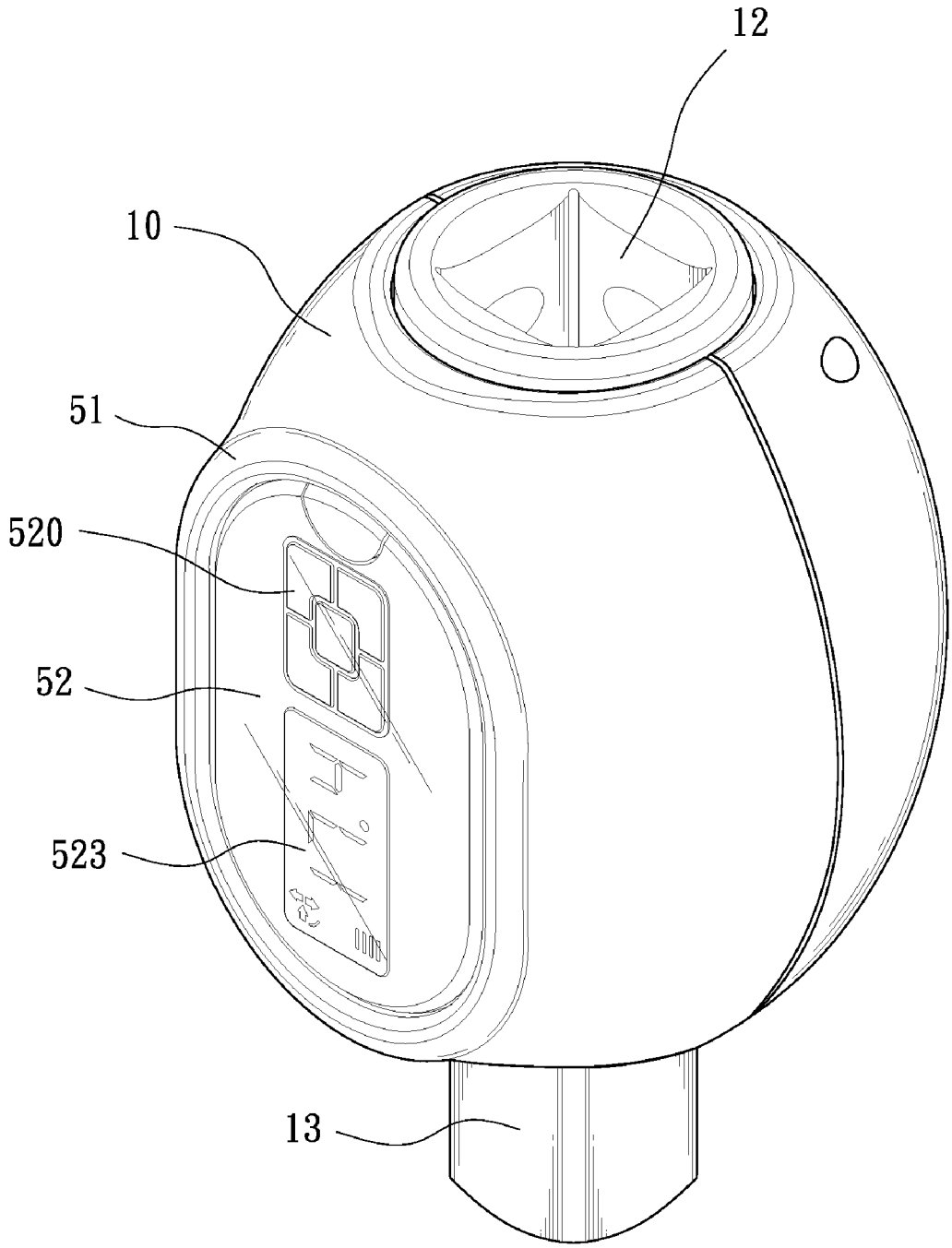
FIG. 7 is a perspective view of a second embodiment of the torsion tool in accordance with the present invention.

With reference to FIG. 7, the second embodiment of the torsion tool in accordance with the present invention is an extension shaft of an ordinary wrench (not shown) without display apparatus and the body (10') has an oval-shaped structure, wherein the operated head (13) is a cubic protrusion. A cubic hole (12) is defined in a first end of the body (10') and co-axially corresponding to the operating head (13), wherein the cubic hole (12) is provided to receive a drive shaft of the wrench and the operating head (13) is provided to connected to a socket (not shown). Consequently, the second embodiment of the torsion tool in accordance with the present invention can show the operating torsion value of the ordinary wrench.

When operating the torsion tool in accordance with the present invention, firstly, the torsion value is pre-installed by the function keys (520) of the display module (52). The microcontroller (521) of the display module (52) sends a signal to operate the vibrating set (42) when the operating torsion value reaches the pre-installed torsion value. The vibration from the vibrating set (42) is directly transmitted to operator's hand to alarm the operator for stopping operation such that the vibrating set (42) can indeed alarm the operator when he/she is distracted. At the same time, the microcontroller (521) of the display module (52) simultaneously operates the lighting unit (527) and the voice unit (528) for achieving the purpose of alarming the operator by different ways.

The display module (52) can be detached from the seat (51) when the operating angle is not easy for operator to read the torsion value from the display unit (523) and the detached display module (52) can be adhered to a machine tool of a workpiece for operator to easily read the torsion data from the display unit (523).

In the preferred embodiment of the present invention, the switch (515) of the seat (51) is a push switch or a vibration switch that can automatically cut off the power of the seat (51) when the torsion tool is idled for a period of time for saving energy. The seat (15) works again for computing torsion value and transmitting torsion data when the switch (515) is pushed again or senses a vibration.

Although the invention has been explained in relation to its preferred embodiment, it is to be understood that many other possible modifications and variations can be made without departing from the spirit and scope of the invention as hereinafter claimed.

What is claimed is:

1. A torsion tool comprising:

a body having an operating head formed thereon for driving a workpiece and a power set disposed therein; and a control assembly installed into the body and including:

a seat received in the body and electrically connected to the power set in the body, the seat including an internal microcontroller disposed therein and a sensor electrically connected to the microcontroller, wherein the sensor is disposed in the body for sensing the change of the operating torsion and transmits the change to the change to the microcontroller, a transceiver and a switch respectively electrically connected to the microcontroller, a first conducting set disposed in the seat; and a display module detachably received in the seat for showing torsion value, the display module including a microcontroller disposed therein, the display module including a transceiver disposed therein and electrically connected to the microcontroller of the display module for receiving the signal from the transceiver of the seat and showing on the display module.

2. The torsion tool as claimed in claim 1, wherein the seat includes a first conducting set disposed therein and the display module includes a second conducting set electrically connected to the microcontroller of the display module, wherein the second conducting set is selectively electrically connected to the first conducting set for directly receiving the signal from the microcontroller of the seat.

3. The torsion tool as claimed in claim 1, wherein the switch is a push switch that can automatically cut off the power of the seat when the torsion tool is idled for a period of time for saving energy.

4. The torsion tool as claimed in claim 1, wherein the switch is a vibration switch that can automatically cut off the power of the seat when the torsion tool is idled for a period of time for saving energy.

5. The torsion tool as claimed in claim 1, wherein the display module includes a display unit electrically connected to the microcontroller of the display module for showing the operating torsion value.

6. The torsion tool as claimed in claim 5, wherein the display unit is an LCD displayer.

7. The torsion tool as claimed in claim 6, wherein the display module includes a magnet mounted into a bottom thereof such that the display module can be adhered to a machine tool of a workpiece for operator to easily read the torsion data after the display module being detached from the seat.

8. The torsion tool as claimed in claim 1, wherein the display module includes a power set disposed therein and electrically connected to the microcontroller thereof, the display module directly using the energy from the torsion tool via the seat when the display module is received in the seat, and the first conducting set and the second conducting set are electrically connected to each other.

9. The torsion tool as claimed in claim 1, wherein the display module includes a lighting unit and a voice unit respectively disposed therein and electrically connected to the microcontroller of the display module for alarming the operator by different ways when the operating torsion value reaches the installed torsion value.

10. The torsion tool as claimed in claim 1, wherein the body is a hollow shank and formed with a hand-held portion on a rear end thereof.

11. The torsion tool as claimed in claim 10 further comprising a metal tube inserted into a rear end of the body and a vibrating assembly mounted in the metal tube and corresponding to the hand-held portion, the vibrating assembly including an inner tube inserted into the metal tube and corresponding to the hand-held portion, a vibrating set received in a front end of the inner tube, the power set of the torsion tool received in the inner tube and electrically connected to the vibrating set, and an end piece longitudinally and detachably mounted to a rear end of the inner tube to prevent the power set from detaching from the inner tube, wherein the power set of the vibrating assembly is electrically to the microcontroller of the seat for providing energy.

12. The torsion tool as claimed in claim 11, wherein the metal tube includes multiple through hole defined therein and multiple indentations defined in a rear end thereof, and the inner tube has a flange radially extending from the rear end thereof, multiple protrusions extending from a shoulder of the flange, wherein each protrusion engaged into a corresponding one of the multiple indentations in the metal tube, the inner tube having multiple through holes defined therein, wherein each through hole of the inner aligns with a corresponding one of the multiple through holes in the metal tube for allowing multiple fixing member sequentially extending through the inner tube and the metal tube to hold the inner tube and the metal tube in place in the body.

13. The torsion tool as claimed in claim 12, wherein the inner tube has multiple L-shaped recesses and a groove respectively defined in an inner periphery near the rear end of the inner tube, an opening defined in the inner tube, wherein the opening extends through the inner tube and communicates with the groove, a first conducting plate inserted into the groove, and having a free end extending through the opening and contact with the metal tube.

14. The torsion tool as claimed in claim 13, wherein the end piece includes a skirt extending therefrom and multiple stubs radially extending from an outer periphery of the skirt, each stub selectively engaged into a corresponding one of the multiple recesses for holding the end piece in place on the rear end of the inner tube, a T-shaped groove longitudinally defined in the outer periphery of the skirt and a second conducting plate stably inserted into the T-shaped groove, wherein the second conducting plate has two opposite ends respectively electrically contacting with the power set of the vibrating assembly and the first conducting plate for transmitting energy to the vibrating set via the metal tube.

15. The torsion tool as claimed in claim 11, wherein the inner tube has a trough defined in a front end thereof, the vibrating set electrically connected to the power set of the vibrating assembly and having a motor received in the trough, a counterweight eccentrically mounted to a shaft of the motor such that the vibrating set provides a vibrating effect for alarming the operator when the motor is operated.

16. The torsion tool as claimed in claim 1, wherein the body has an oval-shaped structure and the operating head is a cubic protrusion that extending from a first end of the body, a cubic hole defined in a second end of the body and co-axially corresponding to the operating head, wherein the cubic hole is adapted to receive a drive shaft of the wrench and the operating head is adapted to connected to a socket.

* * * * *